United States Patent [19]

Groth

[11] Patent Number: 5,001,888

[45] Date of Patent: Mar. 26, 1991

[54] METHOD OF PACKAGING AND DISPENSING A MECHANICAL PART

[75] Inventor: Louis K. Groth, Burnsville, Minn.

[73] Assignee: Seagate Technology, Inc., Scotts Valley, Calif.

[21] Appl. No.: 464,920

[22] Filed: Jan. 16, 1990

[51] Int. Cl.[5] ..... B65B 9/02

[52] U.S. Cl. ..... 53/450; 53/553

[58] Field of Search ..... 53/450, 471, 467, 553, 53/555, 545, 558, 141, 452; 493/459

[56] References Cited

U.S. PATENT DOCUMENTS

| | | | |
|---|---|---|---|
| Re. 21,065 | 5/1939 | Copeman | 53/553 |
| 2,833,327 | 5/1958 | Boyce . | |
| 2,897,962 | 8/1959 | Zackheim | 53/450 X |
| 3,020,687 | 2/1962 | Joa | 53/553 X |
| 3,070,102 | 12/1962 | MacDonald | 132/84 |
| 3,394,798 | 7/1968 | Sako | 53/450 X |
| 3,411,978 | 11/1968 | Frohbach et al. . | |
| 3,645,281 | 2/1972 | Seidler | 132/88.7 |
| 4,265,234 | 5/1981 | Schaar | 128/156 |
| 4,345,415 | 8/1982 | Järund | 53/450 |
| 4,418,822 | 12/1983 | Dotta | 206/441 |
| 4,479,319 | 10/1984 | Erlich | 40/595 |
| 4,488,922 | 12/1984 | Instance | 156/192 |
| 4,568,403 | 2/1986 | Egan | 156/247 |
| 4,601,157 | 7/1986 | Adelman | 53/553 X |
| 4,604,153 | 8/1986 | Melbye | 156/235 |
| 4,678,690 | 7/1987 | Palmer et al. | 428/31 |
| 4,702,788 | 10/1987 | Okui | 156/252 |
| 4,726,169 | 2/1988 | Achelpohl et al. | 53/553 X |

*Primary Examiner*—James F. Coan

*Attorney, Agent, or Firm*—Kinney & Lange

[57] ABSTRACT

A method of packaging and dispensing a packaged mechanical part is disclosed. The method includes the steps of placing a plurality of substantially flat mechanical parts having an adhesive-coated surface, including a release backing protecting the coated surface on an adhesive coated flexible film. The parts are oriented such that the release backing contacts the adhesive coating on the flexible film. A second flexible film is positioned over the first film, encapsulating each part and forming a flexible, continuous container. The container is then opened by simultaneously separating the first and second flexible films while rolling the first flexible film over an edged surface, proximate the point of separation of the two films. The method advantageously removes the release backing while delivering the part from the packaging. The part is delivered in a condition which is substantially free of mechanical damage and contamination.

13 Claims, 2 Drawing Sheets

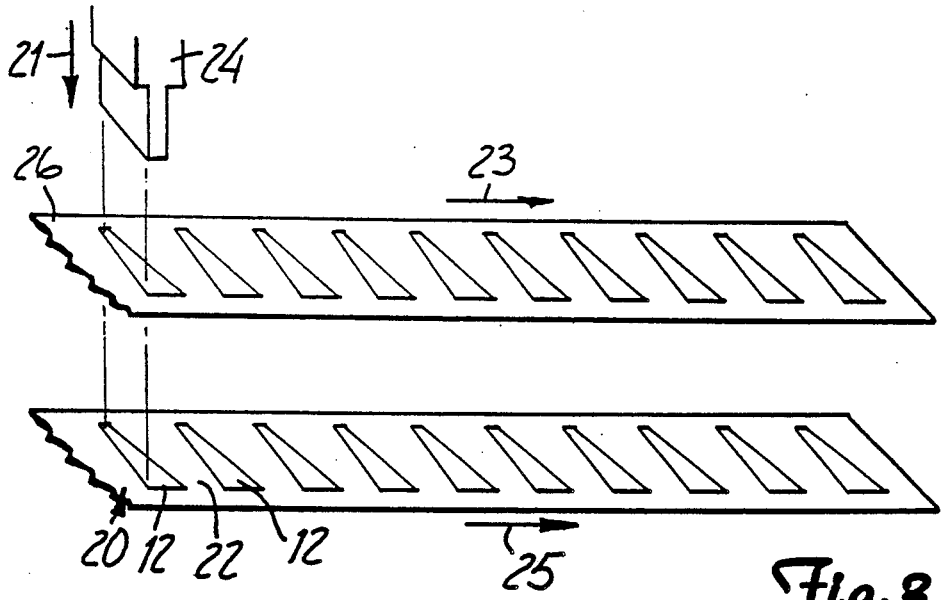
Fig. 3
Fig. 4
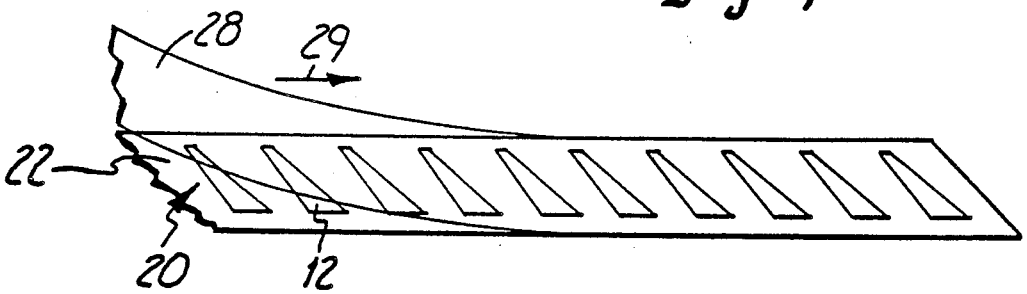
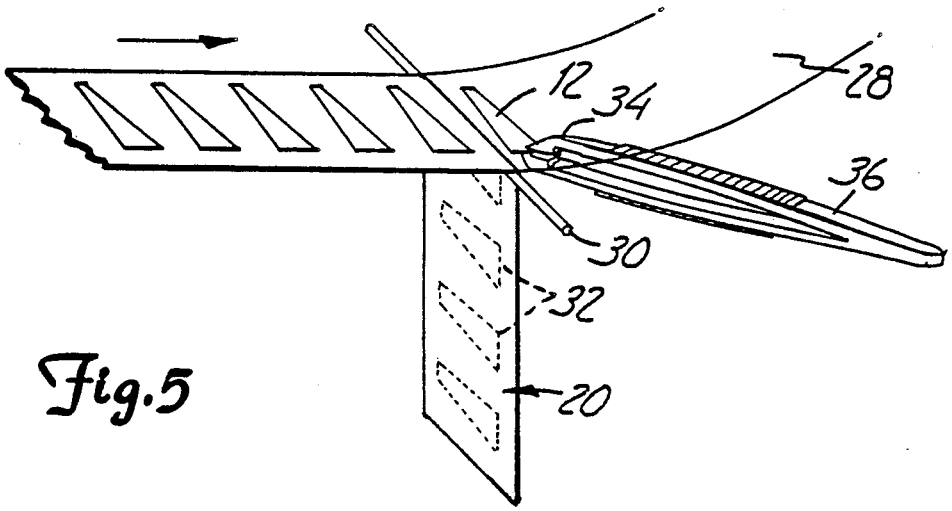
Fig. 5

METHOD OF PACKAGING AND DISPENSING A MECHANICAL PART

BACKGROUND OF THE INVENTION

The present invention relates to packaging for mechanical parts. In particular, it relates to a packaging method for protecting mechanical parts during handling and dispensing to prevent contamination and avoid component damage.

In many industries, it is important to package and handle individual parts to avoid contamination and/or damage. The computer industry is an example. The present invention is described in the context of a computer hard disk but has applications beyond that component and industry.

Hard disk files are computer components which store information. A hard disk file typically has a magnetic recording disk and a magnetic read/write transducer for writing information onto the disk, and reading information from the disk. The transducer is mounted onto a magnetic recording head, which is supported by a spring attached to an actuator arm.

The spring, or flexure provides a force normal to the disk surface which allows the head to remain positioned very close to the disk surface as the disk spins. When the disk is spinning, an air cushion forms between the disk surface and the adjacent head surface, forcing the head away from the disk, in a direction normal to the disk surface. The spring, or flexure provides a force in a direction normal to the disk surface, which compensates for lifting motion of the magnetic recording head, and causes the head to remain close to the disk surface. When the disk comes to rest, the spring presses the head against the disk surface.

During disk file operation, the disk spins and a servo motor positions the magnetic read/write transducer above a track on the disk. As the servo motor moves the head from track to track on the disk surface, the acceleration of the actuator arm causes vibration in the actuator arm spring, which in turn causes the magnetic read/write transducer to vibrate. Also, movement of the head from position to position within the same track causes the actuator spring to oscillate. It is necessary to dampen the vibration in the spring of the actuator arm to maximize the speed in which the hard disk file operates. This dampening may be accomplished by a damper positioned on the spring.

Although it is known in the industry that placing a damper on the actuator arm spring is desirable, it has not been possible prior to the present invention, to handle the dampers without causing some contamination and/or damage. Contaminated and/or damaged dampers often cause the entire hard disk file component to fail quality control tests. The quality control failure of a hard disk file actuator arm, for example, requires that the actuator arm be returned to a clean room atmosphere and thoroughly cleaned before the defective damper is removed and replaced. Recleaning and repairing these components has proven to be both time consuming and expensive.

Presently, dampers are punch pressed from a strip of base stock material, which in a preferred embodiment is a multilayer laminate containing at least one layer of stainless steel. The total laminate thickness is typically about 0.003 inch thick. The stock material 10 is shown in FIG. 1 and has a lower surface which is coated with an adhesive (not shown). A release backing (not shown) is provided in the form of a release tape to protect the adhesive coating, and to prevent the dampers from adhering to the surfaces prior to their desired placement. The dampers 12 are punched from the stock material 10 with a punch press and are immediately returned to their original positions in the cut-out portions of the stock material. When the dampers are cut, the adhesive layer and release backing are also cut. As the dampers are returned to the cut-out areas of the sheet, the edges of the adhesive coating on the dampers bond to the outer edges of the cut-out areas, holding the dampers in place, forming a sheet of dampers as shown in FIG. 1. The dampers may be handled/shipped as a sheet prior to their use.

In order to use the dampers, it is necessary to first separate each damper from the sheet of dampers 10. Presently, this tedious task is accomplished by using very small tools such as tweezers, a pin vice, or a small knife for example. A typical damper 12 is of a substantially wedged shape which is less than one inch in length, and less than one quarter of an inch in width at the widest end. Individually removing each damper has proven to be very difficult and time consuming, and often results in mechanical damage such as dimpling, bending, and nicking. Physically handling the parts also creates more opportunity for exposure to contaminants.

Once each damper/backing has been separated from the sheet, the release backing must next be removed. A common release backing is available in the form of a release tape, and is typically constructed of paper which is coated with a wax or silicone. Although the bond between the adhesive and the wax coated paper is relatively weak, manufacturers who use the dampers have still found it difficult to remove the paper backing from the damper itself, due to the small size of the part. Removing the paper backing often requires the use of tools such as tweezers. This removal procedure often results in bending, and other mechanical damage to the dampers such as nicks, as well as contamination. The above-mentioned procedures are also time consuming and expensive.

Manufacturers of computer components have discovered that the use and handling of actuator arm spring dampers described above results in significant contamination and/or mechanical damage. If the damage or contamination goes undetected, reduced hard disk file performance or possible catastrophic disk drive failure is likely to be a result. If the damage or contamination is detected, additional disassembly, cleaning, and assembly steps are required to produce an acceptable product.

It is known in the art to deliver mechanical parts on a continuous, adhesive coated tape. For example, Okui U.S. Pat. No. 4,702,788 discloses a carrier tape structure having a first film layer with a series of aligned holes near the edge of the tape for receiving the teeth of a sprocket, and another series of aligned apertures near the center of the tape for receiving mechanical parts. Beneath the first film layer is attached a second film layer having an adhesive coating on both sides. The second film layer is wide enough to completely cover the apertures for receiving parts, but is narrow enough to avoid covering the sprocket holes. On the opposite side of the second film layer is a protective peel-off layer. Parts are positioned on the exposed adhesive surfaces on the first film layer. The second layer is severed along the boundary of each aperture so that when a part is removed, the portion of the second film layer contacting a surface of the part is removed with the part.

SUMMARY OF THE INVENTION

The present invention provides a method of handling and dispensing substantially flat mechanical parts which are easily damaged, and which are susceptible to contamination from handling. A "substantially flat" mechanical part is a part that has at least one flat surface. In the practice of the present invention, the flat surface is coated with an adhesive which is, in turn, covered with a release backing, such as a wax or silicone treated paper release tape. The method includes the steps of providing a first flexible film with an adhesive surface and placing a plurality of mechanical parts on the adhesive surface. Each part is positioned such that the release backing contacts the adhesive surface. A second flexible film is provided for covering the parts and for contacting the exposed adhesive surfaces to form a continuous, flexible container having a plurality of individual compartments. The method further includes the step of pulling the first and second flexible films apart while simultaneously rolling that portion of the first flexible film proximate the point of separation over an edged surface. By rolling the first flexible film over an edged surface while separating the films, the release backing releases from the part, and the part is released from the package substantially free from damage and contamination.

BRIEF DESCRIPTION OF THE DRAWINGS

FIG. 3 shows a punch press removing dampers from a sheet of stainless steel, and placing the dampers on a flexible film having an adhesive coating on the upper surface.

FIG. 4 shows the step of joining two flexible films, and individually encapsulating each damper.

FIG. 5 illustrates the step of simultaneously pulling the flexible films apart, while rolling the first flexible film over a sharp edge to release the dampers.

DETAILED DESCRIPTION OF THE PREFERRED EMBODIMENTS

Figure 1:
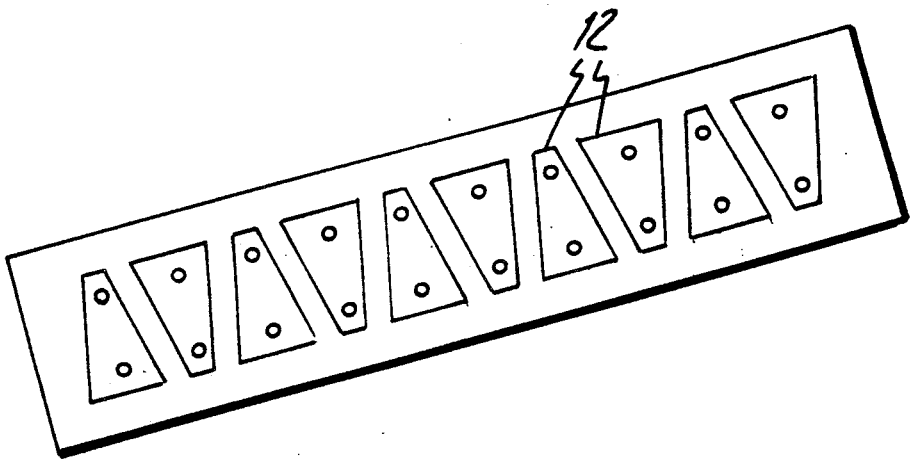
FIG. 1 illustrates a sheet of stainless steel, having a quantity of dampers punched from but retained in the sheet.
Figure 2:
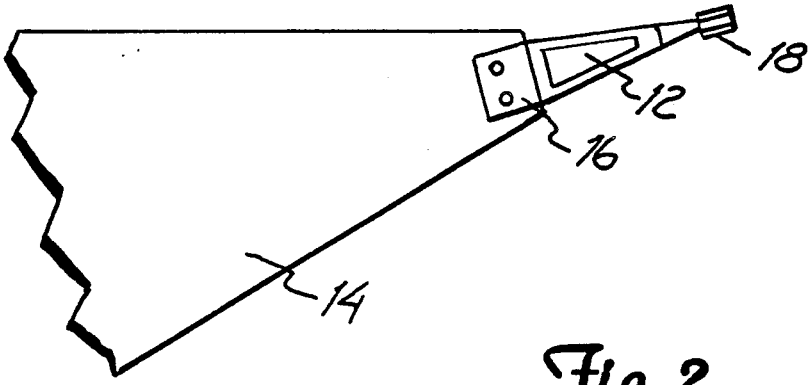
FIG. 2 shows a damper attached to an actuator arm spring, which is mounted onto an actuator arm of a hard disk file.

The present invention is a method of handling and dispensing substantially flat mechanical parts which are easily damaged, and which are susceptible to contamination from handling. In the computer industry, problems are encountered daily in keeping parts free from contamination and/or damage. The parts which form an actuator arm assembly of a hard disk file are no exceptions. One particular part which has been difficult to handle and keep clean while avoiding damage is a small substantially flat wedge shaped part, called a damper. FIG. 2 illustrates a damper 12 mounted on an actuator arm spring 16. The damper 12 has a lower surface coated with an adhesive (not shown), and is adhesively bonded to the upper surface of a spring 16 which is attached to an actuator arm 14 and which supports a magnetic read/write transducer 18. Prior to the placement of the damper 12, its adhesive coated surface is covered/protected by a removable release backing.

In the manufacture of hard disk file actuator assemblies, many contamination and/or damage difficulties have been encountered from the time of manufacture to the placing of the damper 12 onto the spring 16. The present invention provides a novel method of packaging the part which significantly improves the ease of handling, and also reduces the mechanical damage and contamination encountered with current handling methods.

The method, as illustrated in FIG. 3, includes the steps of providing a first flexible film 20 with an upper adhesive surface 22 and placing a plurality of dampers 12 (each having a release backing) onto the adhesive surface 22. The preferred adhesive on the upper surface 22 is pressure sensitive and is capable of bonding to the release backing. "Release backing" for purposes of this disclosure is a flexible film which weakly bonds to adhesives. Typically, such films have a waxy or silicone coating to limit the strength of the bond of the film to the adhesive. The dampers 12 are positioned such that the release backing (not shown) contacts the adhesive surface 22. The preferred first flexible film is a splicing tape for joining ends of release tape, and is manufactured by Minnesota Mining and Manufacturing, Co. of St. Paul, Minn. (3M). Any adhesive backed film which adheres to release backing would be a suitable flexible film to practice the method of the present invention. The preferred splicing tape is about 1⅛ inch wide and is available in rolls.

The preferred method employs the use of a punch press 24 to cut the dampers 12 out of the sheet stock 26. The punch press 24 has a plunger which moves in a direction normal to the surface of the sheet of stock 26, as illustrated by arrow 21. The sheet stock 26 in the preferred embodiment is constructed of a multilayer laminate having at least one stainless steel layer. The dampers known to the inventor are about 0.005 inch thick. As the dampers 12 are punched out of the sheet stock 26, the lower surfaces of the dampers 12 (with an adhesive and release backing) contact the upper adhesive surface 22 of the first flexible film, and form a bond. As the punch press releases pressure, the dampers 12 remain on the surface 22 of the first flexible film 20. The flexible film 20 and the sheet stock 26, according to the preferred method, advance in the directions shown by arrows 23 and 25, while the punch press 24 remains stationary.

A second flexible film 28 as shown in FIG. 4 is next provided for covering the dampers and for contacting the exposed adhesive surfaces 22 surrounding the dampers 12. The preferred flexible film 28 is constructed of transparent polypropylene plastic and is about 1⅛ inch wide. It was discovered that second flexible films 28 which are stiffer than the first flexible film 20 form the best upper film to practice this method. Any flexible film which is capable of later releasing from the adhesive surface 22 of the first flexible film 20 would be suitable to practice the method. In the preferred embodiment, the second flexible film 28 does not have an adhesive surface. However, a second flexible film 28 having one or more adhesive surfaces could be used to practice the present invention.

The two films 20 and 28 are joined together to form a continuous, flexible container having a plurality of individual interior cavities, each holding a damper 12. The preferred method of joining the two films 20 and 28 is by continuously feeding the two films through a pair of pressure rollers (not shown) in the direction of arrow 29 which provide enough force to form a strong adhesive bond between the films. This method is most suitable when the adhesive used to form the first flexible film 20 is of a pressure sensitive nature. Alternatively, a first flexible film 20 containing an adhesive which is heat sensitive is also suitable and requires the application of heat during contacting to form a bond between the two flexible film layers 20 and 28.

By packaging the dampers between two flexible films, a continuous, flexible container is formed which can be rolled, stored, and shipped without damaging or contaminating the dampers. Storing rolls is also more space efficient than the present method of storing strips of stock 26 in an elongated container.

The method further includes the step of pulling the first and second flexible films 20 and 28 apart while simultaneously rolling a portion of the first flexible film 20 over an edged surface 30, as illustrated in FIG. 5. By rolling the first flexible film 20 over an edged surface 30 very close to the point of separation and while separating the films 20 and 28, the release backing 32 (shown in phantom) releases from the damper 12, and the damper 12 is released from the package substantially free from damage and contamination. In the preferred embodiment, the first film 20 is pulled in a direction which is about 90° degrees from the direction of travel of the joined films 20 and 28. Although a change in the direction of travel of the film 20 of about 90° degrees assures detachment of the backing layer from the damper, changing the direction of travel by as little as 45 degrees would also effectively detach the backing layer.

The distance between the point of separation of the films and the position of the edge must be less than the dimension of the part, measured in the direction of travel of the films. In the preferred embodiment, the dampers are placed diagonally across the film 20, and the length of the damper parallel to the direction of travel of the film is about $\frac{3}{4}$ of an inch. The point of separation in the preferred embodiment is in substantially the same location as the position of the edged surface 30.

According to the preferred method, the dampers 12 are removed with tweezers 36 as the dampers are released from the package. The adhesive coated surface of damper 12 is designated 34 in FIG. 5. Alternatively, the dampers may be deposited into an automated device.

A desireable method of pulling the films apart includes passing the films through a pair of rollers (not shown) which are closely spaced and are of a small diameter. For example, a pair of rollers, each having about a one eighth inch diameter would be suitable. The films are pulled in a direction that is different than the direction of the travel of the formed container. In this example, the lower roller (not shown) forms the edged surface 30. In another example, the films may be pulled through 12 inch diameter rollers, with the bottom film passing over a sharp edge positioned about $\frac{1}{8}$ inch from the point of separation. Tension is applied to the individual separated films in a direction opposite the direction of feed such that the individual films wrap around the rollers and are traveling in a direction 180 degrees from the direction of travel of the combined films. It is desirable to apply tension to the trailing end of the films to achieve the best results. As mentioned previously, more rigid films can be used for forming the second flexible film 28. If more rigid films are used, less or no tension on the trailing end of the films is required.

A critical aspect of the present invention is that the release backing 32 adheres more strongly to the adhesive surface 22 of the first film 20 than to the adhesive surface 34 of the damper 12. By selecting a first flexible film 20 which adheres strongly to the release backing 32, and by pulling the first flexible film 20 over a sharp edge at the same time the first and second films 20 and 28 are being separated, the adhesive-backed damper is released from the backing and the package. The damper is free of contamination and mechanical damage due to handling.

Another critical aspect of the present invention is that the mechanical part is more rigid than the first flexible film 20. Only by relying on the relative rigidity of the mechanical part compared to the flexibility of the film 20 it possible to release the part from the first flexible film 20 as the film passes over an edged surface 30. The second film 28 may also assist in separating the part from film 20 by holding the part down—by preventing it from "tipping" over the edged surface 30.

When separated, the dampers may be installed onto the spring 16 (shown in FIG. 2) in a clean environment, either manually or with the aid of automation. The method of the present invention reduces the frequency of quality control rejection of the damper component by eliminating damage and contamination occurring during the manual steps of removing the punched damper from the base stock, and removing the release backing from the adhesive backed damper.

Although the method of the present invention describes a method of handling a damper, the present invention includes a method of packaging and handling a wide variety of substantially flat parts or parts having a flat surface requiring careful handling and a minimum of contamination. In particular, it applies to packaging any relatively rigid part that is substantially flat and has an adhesive surface covered with a release backing.

Although the present invention has been described with reference to preferred embodiments, workers skilled in the art will recognize that changes may be made in form and detail without departing from the spirit and scope of the invention.

What is claimed is:

1. A method of packaging and dispensing a relatively rigid mechanical part having an adhesive surface, wherein the adhesive surface of the part is covered with a protective release backing, the method comprising:

providing a first flexible film with an adhesive surface, wherein the film is less rigid than the mechanical part;

positioning at least one mechanical part on the adhesive surface of the first flexible film, the release backing contacting the adhesive surface of the first flexible film;

providing a second flexible film;

joining a surface of the second flexible film to the adhesive surface of the first flexible film, thereby enclosing each part and forming at least one flexible container;

separating the first flexible film and the second flexible film at a defined position; and rolling the first flexible film over an edged surface proximate the defined position while the first and second films are being separated, thereby releasing the part from the release backing and the container.

2. The method of claim 1 wherein the steps of separating the first and second flexible films and rolling the second flexible film over an edged surface further includes applying tension to the individual films in an amount sufficient to cause the films to separate.

3. The method of claim 1 wherein the mechanical part is a substantially flat damper.

4. The method of claim 1 wherein the second flexible film is more rigid than the first flexible film.

5. The method of claim 4 wherein the damper is more rigid than the flexible films.

6. The method of claim 1 wherein the step of positioning the part on the first flexible film includes delivering the part to the film with a punch press.

7. The method of claim 1 wherein the adhesive of the first flexible film adheres to the second flexible film and forms a bond which is weak enough to release the second film when the films are manually separated.

8. The method of claim 1 wherein the strength of the mechanical bond between the release backing and the adhesive surface of the first flexible film is greater than the strength of the mechanical bond between the release backing and the adhesive surface of the mechanical part.

9. The method of claim 1 wherein the first flexible film is moved in a direction which is at least forty-five degrees from the direction of the feed after the film contacts the edged surface.

10. The method of claim 1 wherein the first flexible film is moved in a direction which is about ninety degrees from the direction of the feed after the film contacts the edged surface.

11. The method of claim 1 wherein the films are traveling in a defined direction, and the step of separating the first flexible film from the second flexible film includes applying a force to an upper surface of the second flexible film in a direction normal to the film surface, and an opposite force to a lower surface of the first flexible film in a direction opposite the first force proximate a line of separation, wherein the distance between the line of separation of the first and second flexible layers and the edged surface is smaller than a length of the mechanical part, measured in a direction substantially parallel to the direction of travel of the films.

12. The method of claim 1 wherein the step of joining the surface of the second flexible film to the adhesive surface of the first flexible film further comprises the step of applying a force to a surface of the second flexible film, and an opposite force to a lower surface of the first flexible film, in a direction normal to the surfaces.

13. In a method of forming a package for a mechanical part with a substantially flat surface having an adhesive coating covering the flat surface, and a release backing covering the adhesive coating, the steps comprising:

providing a first flexible film with an adhesive surface;

positioning at least one substantially flat mechanical part on the adhesive surface of the first flexible film, the release backing contacting the adhesive surface of the first flexible film;

providing a second flexible film; and joining a surface of the second flexible film to the adhesive surface of the first flexible film, enclosing each part and forming at least one flexible container, and when the first and second flexible films are later separated and the first flexible film is at the same time rolled over an edged surface, each part is released from the protective layer and from the package.

* * * * *